United States Patent [19]

Shaw

[11] 4,185,465

[45] Jan. 29, 1980

[54] MULTI-STEP REGENERATED ORGANIC FLUID HELICAL SCREW EXPANDER HERMETIC INDUCTION GENERATOR SYSTEM

[75] Inventor: David N. Shaw, Unionville, Conn.

[73] Assignee: Dunham-Bush, Inc., West Hartford, Conn.

[21] Appl. No.: 881,449

[22] Filed: Feb. 27, 1978

Related U.S. Application Data

[63] Continuation-in-part of Ser. No. 782,675, Mar. 30, 1977, Pat. No. 4,086,072, which is a continuation-in-part of Ser. No. 653,568, Jan. 29, 1976, Pat. No. 4,058,988.

[51] Int. Cl.[2] ..... F01K 7/34

[52] U.S. Cl. ..... 60/678; 290/52

[58] Field of Search ..... 60/651, 671, 677, 678; 418/201, 202; 62/238 C, 160; 290/40 R, 40 C, 52

[56] References Cited

U.S. PATENT DOCUMENTS

| | | | |
|---|---|---|---|
| 2,511,854 | 6/1950 | Kane | 290/52 |
| 2,916,635 | 12/1959 | Nicita | 290/40 |
| 3,088,659 | 5/1963 | Nilsson et al. | 230/138 |
| 3,362,163 | 1/1968 | Pacault | 60/67 |
| 3,413,805 | 12/1968 | Heller et al. | 60/651 |
| 3,423,933 | 1/1969 | Knizia | 60/67 |
| 3,432,089 | 3/1969 | Schibbye | 230/138 |
| 3,936,239 | 2/1976 | Shaw | 417/315 |
| 4,079,263 | 3/1978 | Inoue | 290/52 |

*Primary Examiner*—William E. Wayner
*Assistant Examiner*—Harry Tanner
*Attorney, Agent, or Firm*—Sughrue, Rothwell, Mion, Zinn and Macpeak

[57] ABSTRACT

A helical screw,expander generator system preferably incorporates a hermetic helical screw expander and induction generator unit with the expander incorporated within a closed loop fluid circuit including an expander boiler upstream of the expander and a condenser downstream with the closed loop circuit carrying an organic working fluid, and the expander boiler receiving heat from a solar or reclaim heat source. The expander carries at least one slide valve for controlling expander capacity. Ejection ports may be carried by additional slide valves for ejecting partially expanded working fluid which is fed to first and second stage heat regenerators to preheat the liquified working fluid as it passes from the condenser to the expander boiler to permit cycle efficiency to approach the theoretical Carnot limits of the system. The expander may comprise four slide valves including an inlet or capacity control slide valve, first and second stage regenerator ejection slide valves for the first and second stage regenerators and a pressure matching slide valve for preventing overexpansion or underexpansion of the working fluid which discharges over the generator windings for cooling of the generator in a hermetic unit.

7 Claims, 2 Drawing Figures

MULTI-STEP REGENERATED ORGANIC FLUID HELICAL SCREW EXPANDER HERMETIC INDUCTION GENERATOR SYSTEM

This application is a continuation-in-part application of application Ser. No. 782,675 filed Mar. 30, 1977 now Pat. No. 4,086,072, Apr. 25, 1978, and which is a continuation-in-part of Ser. No. 653,568, Jan. 29, 1976, Pat. No. 4,058,988, and entitled "AIR SOURCE HEAT PUMP WITH MULTIPLE SLIDE ROTARY SCREW COMPRESSOR EXPANDER", to the same inventor, and assigned to the common assignee, now U.S. Pat. No. 4,086,072.

FIELD OF THE INVENTION

This invention relates to helical screw expander systems, and more particularly, to an expander driven electrical generator system which may form a part of a refrigeration system employed to heat or cool a building enclosure or the like.

Applicant's U.S. Pat. Nos. 3,936,239 and 4,058,988 employ helical screw rotary compressors within a heat pump system for selective heating and cooling of system loads with the compressor employing multiple, axially shiftable slide valves for controlling the capacity of the compressor; matching the closed thread pressure of the compressor at discharge to discharge line pressure, controlling the point of injection of a refrigerant gas return from a subcooling or economizer coil or an intermediate pressure evaporator, or ejection of partially compressed working fluid for supplying thermal energy to an intermediate pressure condenser or like heat exchanger for instance, within a secondary closed refrigeration loop operating at a pressure less than that of the primary refrigeration loop. In applicant's copending application Ser. No. 782,675, now U.S. Pat. No. 4,086,072, there is included in addition to the helical screw rotary compressor, a helical screw rotary expander which incorporates multiple slide valves and which expands the refrigerant working fluid to drive the compressor or by overspeeding the rotor of an induction electrical motor delivers electrical power to network feeding the drive motor electrical energy, particularly under low compressor load conditions. The flow of refrigerant working fluid to the expander is controlled such that expander operation occurs only under certain conditions where energy is available to drive the compressor and/or electrical motor and to overspeed the motor to cause it to function as an electrical generator and deliver electrical power output from the heat pump system. In that application, high pressure refrigerant working fluid in vapor form may be supplied by a solar reclaim evaporator/expander boiler receiving thermal energy from the sun or by heat reclaim from the space being conditioned by the heat pump system or alternatively by an auxiliary combustion boiler depending upon system requirements. In that application, the slide valves comprise two in number, to control the mass flow rate of refrigerant working fluid being expanded within the expander and to perform a pressure matching function which matches the pressure within a closed thread at the outlet of the expander to the outlet pressure of that expander.

The present invention is directed to an expander driven generator system operating under these principles, preferably in a closed loop fluid system utilizing an organic working fluid or the like and in conjunction with a hermetic unit which includes at least a helical screw rotary expander for driving an electrical induction generator and permitting the utilization of thermal energy from a storage tank, solar energy source or reclaim souce to generate available electrical energy and provide a source of supplemental heat for heating a building enclosure or the like.

SUMMARY OF THE INVENTION

Preferably, the invention comprises an expander powered electrical generator system including a helical screw rotary expander, an electrical induction generator mechanically coupled to the expander and being driven thereby, a condenser, a boiler, conduit means carrying a vaporizable working fluid and forming a closed loop circuit including in series, the expander, the condenser and the expander boiler. The expander includes at least one axially adjustable slide valve for varying the capacity of the expander. The improvement resides in at least a first stage regenerator within the closed loop between the condenser and the boiler and said slide valve includes an ejection port open to a closed thread of the expander intermediate of the expander inlet and outlet and connected to the first stage regenerator for supplying partially expanded refrigerant vapor to the first stage regenerator for regeneratively heating the condensed refrigerant passing from the condenser to the boiler and means for adding the condensed refrigerant within the regenerator to the line supplying condensed refrigerant from the condenser to the boiler at line pressure downstream of the regenerator. Preferably, a second stage regenerator is incorporated within the closed loop circuit upstream of the first stage regenerator, and the expander further comprises a second slide valve carrying a second stage ejection port and means for connecting the second stage ejection port to the second stage regenerator for supplying thereto partially expanded refrigerant vapor at a pressure less than that provided to the first stage regenerator, and means for supplying condensed refrigerant vapor from the second stage regenerator to the line carrying the flow of condensed refrigerant from the condenser to the boiler, at a point upstream of the first stage regenerator. Gas pressure powered pumps may be employed for pressurizing the condensed refrigerant within the first and second stage regenerators prior to supplying that condensed refrigerant to the closed loop circuit leading from the condenser to the boiler.

In a preferred form, the expander employs first, second, third and fourth slide valves, with the first slide valve constituting a capacity control inlet slide valve for varying capacity of the expander, the second slide valve comprises an ejection slide valve carrying the ejection port for the first stage regenerator, the third slide valve comprises a second stage injection slide valve and carries an injection port connected to the second stage regenerator, and the fourth slide valve comprises a pressure matching slide valve controlling the outlet port for the expander and including a pressure sensing port open to a expander closed thread adjacent the outlet port of the expander and sensing expander pressure immediately before discharge. The system further comprises control means for shifting the first slide valve in response to the pressure of the refrigerant vapor within the boiler, means for controlling the position of the second slide valve in response to leaving liquid temperature of the first stage regenerator, means for controlling the position of the third valve in response to leaving liquid temperature of the second stage regenerator and means for controlling the position of the fourth valve in response to the difference between the pressure within the closed thread of the expander just before discharge and the outlet port pressure of the expander.

The helical screw expander and induction generator may comprise a hermetic unit with the generator mounted on the discharge side of the expander and the hermetic unit including means for discharging the expanded refrigerant working fluid from the expander over the windings of the electrical induction generator for cooling of the generator windings and means for connecting the hermetic unit downstream of the generator to the condenser for supplying to the condenser expanded refrigerant vapor after cooling of the motor. The refrigerant working fluid may comprise trifluoroethanol, toluene or the like.

DESCRIPTION OF THE PREFERRED EMBODIMENT

Figure 1:
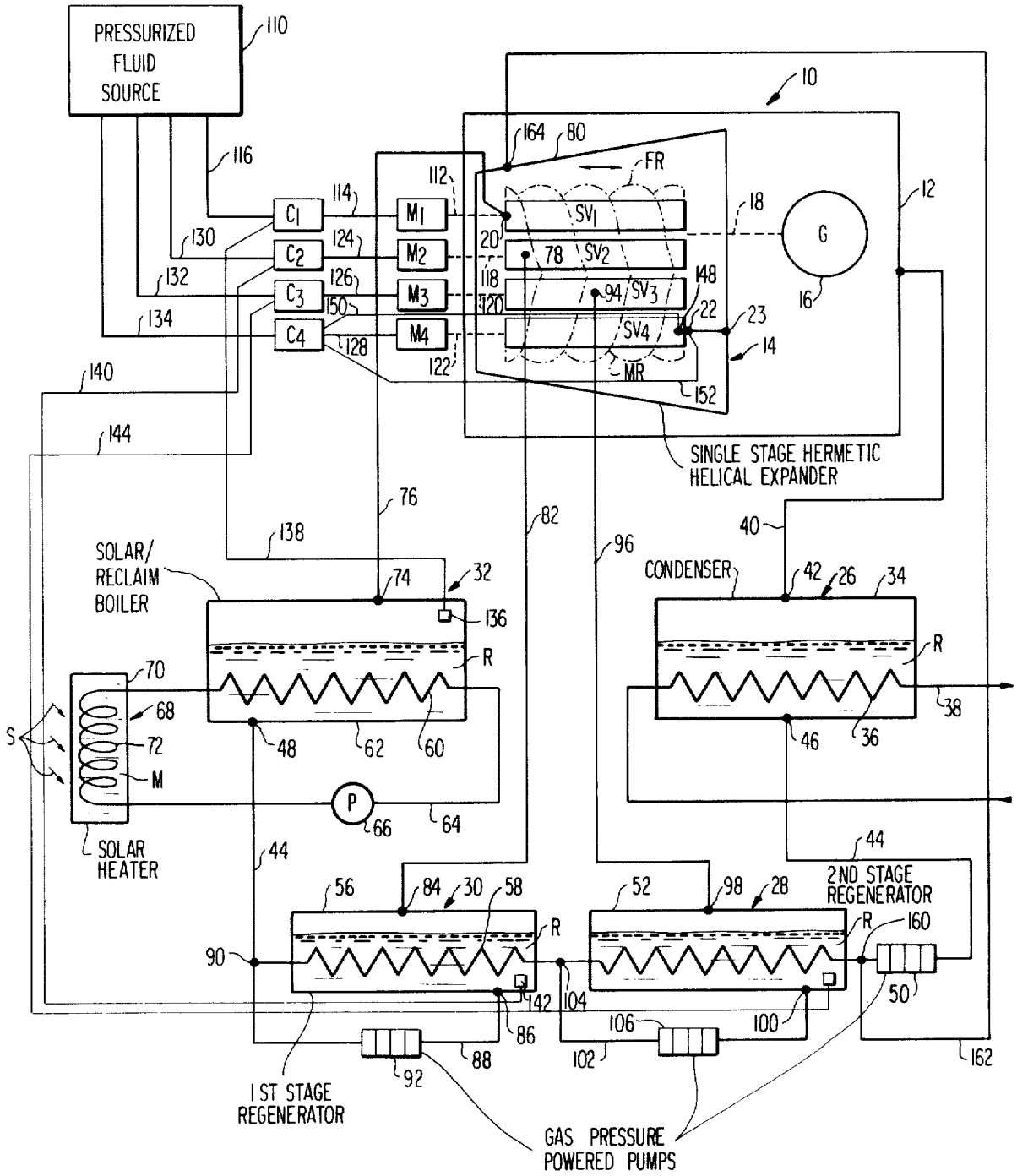
FIG. 1 is a schematic diagram of a two step regenerated trifluoroethanol helical screw expander hermetic induction generator system forming one embodiment of the present invention.

The present invention comprises an improved, closed loop multiple step regenerated helical screw expander hermetic induction generator system, wherein, as illustrated in FIG. 1, a helical screw rotary expander/induction generator hermetic package unit is indicated generally at 10 and includes a hermetic casing 12 within which is housed the helical screw rotary expander 14 and an electrical induction generator 16 which is mechanically coupled thereto by way of shaft 18 such that the expander 14 acts to drive the generator 16 under normal conditions. The helical screw rotary expander 14 is similar to the expander 20 of copending application Ser. No. 782,675, now U.S. Pat. No. 4,086,072, and is also similarly constructed to the helical screw rotary compressor of U.S. Pat. No. 4,058,988. Further, the expander slide valves may be of the type shown in Pat. No. Re. 29,283 issuing to applicant and also assigned to the common assignee. However, it is not necessary that the slide valves be provided in the area of intermesh between the helical screw rotors, the slide valves may in fact be circumferentially displaced therefrom, and define a portion of the envelope for either the male or female helical screw rotors. However, preferably, the helical screw expander comprises four axially or longitudinally adjustable slide valves indicated schematically at $SV_1$, $SV_2$, $SV_3$, and $SV_4$. The slide valve $SV_1$ comprises an inlet or expansion capacity control valve. The slide valve $SV_2$ comprises an ejection slide valve for ejection of a partially expanded working fluid in vapor or gas form at a pressure intermediate that of the inlet and discharge or outlet sides of the expander 14 as defined by the expander inlet port 20 and the expander outlet port 22. Slide valve $SV_3$ comprises an ejection slide valve for supplying a portion of further expanded working fluid in vapor form to the second stage regenerator of the system, while slide valve $SV_4$ constitutes a pressure matching slide valve for matching the pressure of the working fluid in vapor form within a screw compressor closed thread just prior to that closed thread opening to the discharge port 22 of the compressor at compressor discharge pressure.

The function of the slide valve $SV_4$ is to prevent working fluid underexpansion or overexpansion in the manner of U.S. Pat. No. Re. 29,283. Slide valve $SV_1$ constitutes for the expander, a capacity control or inlet slide valve and limits the expansion of the high pressure working fluid vapor entering the expander at inlet 20. Slide valve $SV_1$ effectively directs the gas for expansion into the expansion chamber area of the intermeshed helical screw rotors such as male rotor MR and female rotor FR with the function of the slide valve $SV_1$ limiting the extent of the expansion path of the working fluid from inlet 20 to outlet 22. The hermetic unit 10 comprises one component within a closed loop system incorporating a vaporizable working fluid, which working fluid R may constitute a suitable refrigerant such as R22 or an aliphatic or aromatic organic compound having good vaporization and condensation characteristics such as trifluoroethanol, toluene or the like. In the illustrated embodiment of the invention, the working fluid R constitutes trifluoroethanol. The system further includes a system condenser 26, a first stage regenerator 28, a second stage regenerator 30 and a solar/reclaim boiler 32. These elements constitute the principal components of a primary closed loop fluid vaporization and condensation system. The condenser 26, the first stage regenerator 30, the second stage regenerator 28, and the boiler 32 constitute heat exchangers. In this regard, the condenser 26 constitutes a casing 34 bearing a coil 36 which coil 36 carries a liquid coolant such as water and is connected within a conduit 38, thus supplying water to the condenser 26 for condensing the working fluid R with the leaving water temperature of the condenser being employable to heat a building enclosure or the like. As mentioned previously, the expander 14 discharges at 23, the expanded working fluid R in vapor form into the hermetic casing 12 for cooling of the hermetic induction generator windings for generator 16, the working fluid leaving the hermetic casing 12 by means of conduit 40 which opens to the inlet 42 of the condenser 26. Outlet 46 of the condenser is connected by way of conduit 44 to the inlet 48 of the solar/reclaim boiler 32. Within conduit 44 is provided the first and second stage regenerators 30 and 28 in reverse order. In that regard, it is necessary to pressurize the working fluid R in liquid form within the condenser 26 to a relatively high pressure from approximately low discharge pressure at the expander outlet prior to the same working fluid entering the expander inlet 20. In that regard, it is more efficient to pump the working fluid R in liquid form and, preferably, the system includes a primary gas pressure powered liquid pump 50 within line 44 upstream of the second stage regenerator 28. The pump 50 is of the piston recycle type and functions to raise the pressure of the working fluid R to a pressure of approximately 520 psia in the illustrated embodiment.

The second stage regenerator 28 comprises a casing 52 which carries a heat exchange coil 54 connected within line 44, with the outlet of the second stage regenerator coil 54 being connected directly to the inlet of the first stage regenerator coil 58. The first stage regenerator 30 also comprises a casing or housing 56 and carries its heat exchange coil 58 in series with the coil 54 of regenerator 28 and incorporated within line 44 leading from the condenser 26 to the solar/reclaim boiler 32. The outlet of the first stage regenerator coil 58 is connected directly to the inlet 48 of the solar/reclaim boiler 32. High pressure, relatively high temperature and preheated liquid working fluid R enters the inlet 48 of the solar/reclaim boiler 32 and is vaporized at high pressure within the boiler by the heat carried by a circulated fluid with a closed loop heating circuit including a heat exchange coil 60 carried within the casing or housing 62 of the solar/reclaim boiler 32. Coil 60 is incorporated within the closed loop formed by a conduit or line 64 which also carries a pump 66 for positive circulation of the heat exchange fluid such as water between the solar/reclaim boiler 32 and a solar heater indicated generally at 68. The solar heater 68 may constitute a casing or housing 70, carrying a media M which is readily directly heated by the solar radiation indicated by the multiple arrows S. Immersed within that media M is a heat exchange coil 72, the ends of which are connected by line 64 to the solar/reclaim boiler 32. Thus, a closed loop circuit is formed including the heat exchange coil 60 within the solar/reclaim boiler 32, the pump 66 and the heat exchange coil 72 within the solar heater 68. The solar heater 68 may be replaced by a storage tank and the storage media therein may constitute water, for instance. In any case, the function of the solar heater 68 is to absorb solar radiation and to effect heating of the primary working fluid R which enters the solar/reclaim boiler as a liquid under high pressure. The vaporized working fluid R exits the solar/reclaim boiler through boiler outlet 74 and passes to the inlet port 20 of the expander 14 through line 76.

A very important aspect of the present invention resides in multiple stage regenerators, such as the first and second stage regenerators 30 and 28. In that respect, at a point downstream of inlet 20, the first stage slide valve $SV_2$ is provided with an ejection port 78 which opens to a closed thread as defined by the casing 80 of the hermetic rotary helical screw expander 14 and the male and female helical screw rotors MR and FR, respectively. A first stage regenerator working fluid supply line 82 is connected to the port 78 at one end, and connected to the inlet 84 of the first stage regenerator casing 56 to permit partially expanded working fluid in vapor form to enter the interior of the first stage regenerator 30 and to condense in contact with the heat exchanger 58 imparting thermal energy to the liquid working fluid being pumped from the condenser 26 to the solar/reclaim boiler 32 by way of the primary loop main pump 50. Outlet 86 at the bottom of casing 56 permits the liquid working fluid R condensing within the first stage regenerator to exit from the first stage regenerator by way of line 88 which is connected to line 44 at point 90 downstream of the outlet of the first stage regenerator. In order to bring the pressure of the liquid refrigerant or working fluid R within the first stage regenerator 30 to the line pressure of the working fluid discharging from pump 50, a secondary gas pressure powered pump 92 is incorporated within line 88, the pump 92 being similar in construction and identical in operation to that of pump 50 within line 44. Appropriately, check valves may be employed within the various lines such as line 88 to insure flow from the pump in the direction of the solar/reclaim boiler 32 but to prevent working fluid from line 44 from backing up into the first stage regenerator 30, the same being true for the second stage regenerator 28.

In the illustrated embodiment of the invention, slide valve $SV_3$ constitutes the ejection slide valve for the second stage regenerator 28, and in that respect, the slide valve $SV_2$ is provided with an ejection port 94 connected to one end of a second stage regenerator supply line or conduit 96, the opposite end of which is connected to inlet 98 of casing 52 of the second stage regenerator 28. Thus, further expanded working fluid R in vapor form is provided to the second stage regenerator, where the vapor condenses to a liquid by contacting the heat exchange coil 54 of the second stage regenerator carrying working fluid in liquid form emanating from condenser 26. The condensed working fluid R within the second stage regenerator 28 exits through outlet 100 of that element and passes by way of line 102 to point 104 within line 44 leading from the condenser 26 to the boiler 32. Point 104 is located intermediate of the heat exchange coils 54 and 58, of the second stage regenerator 28 and the first stage regenerator 30, respectively. The line 102 includes a gas pressure pump 106 which may in fact be identical to pump 92 associated with the first stage regenerator and like that pump is preferably of the piston recycle type. Appropriate check valves may be employed within line 102 for preventing high pressure liquid working fluid within line 44 from backing up into the casing 52 of the second stage regenerator 28. Further, check valves may be employed within supply lines 82 and 96 leading from the expander to the regenerators 30 and 28, respectively, to permit vapor flow from the expander to the regenerator casings 56 and 52, respectively, but not vice versa.

In similar manner to applicant's prior patents U.S. Pat. No. Re. 29,283 and U.S. Pat. No. 4,058,988, each of the slide valves are driven longitudinally by a suitable motor under control of a control device responsive to given system parameters for shifting of the slide valve between extreme positions. The motors may take the form of hydraulic cylinders responsive to the application or removal of a pressurized fluid on respective sides of a piston slidably carried by such hydraulic cylinders with the hydraulic fluid being supplied by a suitable pressurized fluid source, as at 110. In that regard, the slide valve $SV_1$ is mechanically connected to motor $M_1$ by a mechanical connection such as rod 112. In turn, the motor $M_1$ receives hydraulic liquid for actuation of the same through suitable conduit means or line 114 which connects the control device $C_1$ to motor $M_1$. The control device $C_1$ is connected to the source of pressurized fluid by conduit 116. In similar fashion, the motor $M_2$ is connected to its slide valve $SV_2$ by way of shaft 118, motor $M_3$ to its slide valve $SV_3$ by way of mechanical connection or shaft 120, and motor $M_4$ to its slide valve $SV_4$ by way of shaft or mechanical connection 122. Motor $M_2$ is connected hydraulically to its control device $C_2$ by line 124; motor $M_3$ to control device $C_3$ by way of line 126; and motor $M_4$ to its control device $C_4$, by way of line 128. In turn, the control devices are connected to the source of pressurized fluid such as a liquid under hydraulic pressure by way of suitable lines paralleling line 116; control device $C_2$ being connected to the source 110, by way of line 130; control device $C_3$ being connected to the source 110, by way of line 132 and control device $C_4$, by line 134.

As mentioned previously, the slide valve $SV_1$ acts to control the capacity or expansion capability of the rotary helical screw expander 14. In that regard, the position of the inlet slide valve $SV_1$ is dependent upon the pressure generated within the solar/reclaim boiler 32 and the boiler carries a pressure sensor as at 136 which is connected by way of line 138 to control device $C_1$, such that, depending upon the pressure within the boiler 32, the inlet slide valve $SV_1$ shifts the inlet port 20 to a position towards or away from the outlet 22 of the expander, thus shortening or lengthening the expansion process.

The position of slide valve $SV_2$ which carries the ejection port 78, for supplying partially expanded working fluid R in vapor or gas form to housing or casing 56 of the first stage regenerator 30, is controlled by operation of motor $M_2$ via control device $C_2$; control device $C_2$ receiving a control signal input by way of a line 140 which leads from a thermostat or temperature sensor, such as thermobulb 142 responsive to the leaving liquid temperature of the first stage regenerator 30. In like fashion, a line 144 extends from a thermostat or temperature sensor such as a thermobulb 146 within the leaving liquid of the second stage regenerator 28 to control device $C_3$.

The fourth slide valve $SV_4$ functioning as a pressure matching slide valve bears a pressure sensing port 148 (or other pressure sensing device on the slide valve) and is open to a closed thread of the intermeshed male and female screw rotors MR and FR at a point just before or adjacent the discharge or outlet port 22 for the compressor as defined by the slide valve $SV_4$ and compares that closed thread pressure to the discharge pressure at the outlet port 22. In that regard, assuming that the pressure sensing element constitutes simply a pressure sensing port 148 within the slide valve $SV_4$, that port is connected by way of line 150 to the control device $C_4$, the control device $C_4$ also having connected thereto a line 152 which leads from the discharge port 22 to the control device. The control device $C_4$ constitutes a comparing means for comparing the two pressures such that if the pressure within the closed thread just prior to discharge is higher than that of the discharge port 22, the control device causes a pressurized fluid from source 110 to pass via lines 134 and 128 to the motor $M_4$ so as to shift the slide valve $SV_4$ to the right as shown, to further expand the working fluid prior to opening that closed thread to the discharge side of the expander. Likewise, if the compressed working fluid R within the closed thread just prior to discharge is at a lower pressure and thus overexpanded with respect to the discharge pressure at discharge port 22, the slide valve $SV_4$ is caused to shift to the left to eliminate the overexpansion condition. Thus, under all circumstances and in line with the issued patents noted previously, it is the function of slide valve $SV_4$ to prevent overexpansion or underexpansion of the working fluid R within the primary loop system.

Figure 2:
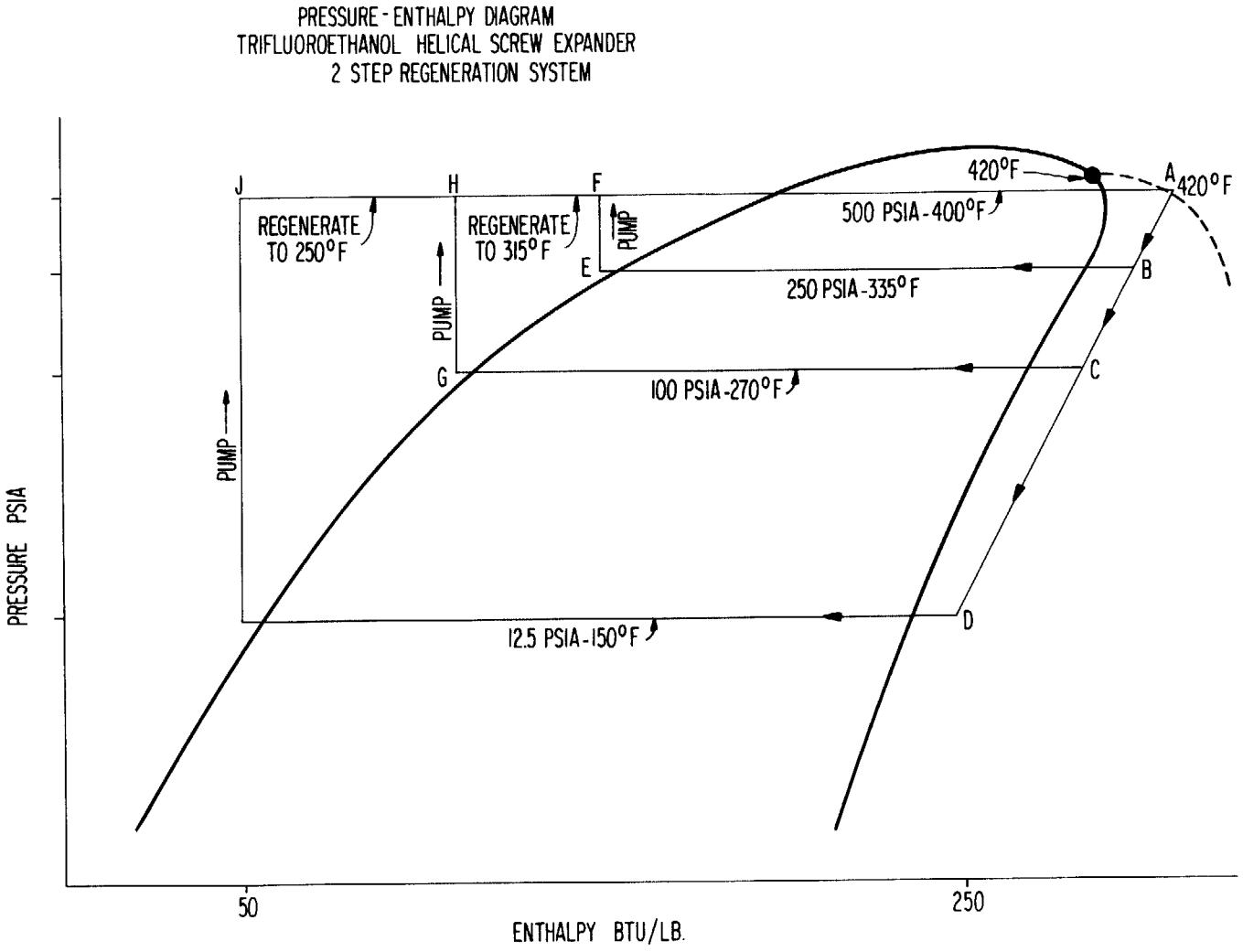
FIG. 2 is a pressure-enthalpy diagram for the expander induction generator system of FIG. 1.

The operation of the multiple step regenerated trifluoroethanol helical screw expander hermetic induction generator system of the invention in terms of the illustrated embodiment may be further appreciated by reference to FIG. 2. The pressure enthalpy diagram illustrates in the top right hand corner, at point A, the condition of the working fluid as it enters inlet 20 of the single stage hermetic rotary helical screw expander 14, the working fluid being at essentially 420° F. and at a pressure of approximately 500 psia; a slight superheat condition. The expansion of the working fluid within the expander follows the path from A to D. At point B, a portion of the partially expanded working fluid R escapes from the expander by way of ejection port 78 of slide valve $SV_2$, its temperature being approximately 335° F. and its pressure 250 psia which working fluid in vapor form enters the first stage regenerator 30. There the temperature is further reduced to 315° F., giving up some of its heat to the working fluid passing by way of line 44 from the condenser 26 to the boiler 32, the condensed working fluid R within the first stage regenerator 30 being pumped up to the pressure in the neighborhood of 500 psi (preferably equal to the 520 psia pressure developed by the primary line pump 50 supplying liquid working fluid from condenser 26 to boiler 32). This condensed pressurized working fluid merges with the liquid working fluid received from condenser 26, along with that picked up from the second stage regenerator 28 at point 104 downstream of the first stage regenerator, point F corresponding to point 90 of the schematic diagram of FIG. 1.

As mentioned previously, the control for slide valve $SV_2$ is from leaving liquid temperature from the first stage regenerator 30 as provided by the thermostat or temperature sensor 142. For instance, if the leaving liquid temperature falls below 315° F., the slide valve $SV_2$ is pulsed closer to the inlet port 20 of the expander 14 and therefore the first stage regenerator 30 receives more mass flow of working fluid R, thus accomplishing the additional heat transfer necessary to bring up the temperature to 315° F. which is the set point of the thermostat or temperature sensor 142. Conversely, if the temperature tends to rise, insofar as the first regenerator 30 is concerned, the ejection slide $SV_2$ would be pulsed closer to the outlet 22, thus reducing mass flow to this regenerator.

In similar fashion, the second ejection slide valve $SV_2$ is shifted depending upon the temperature of the leaving liquid R from the second stage regenerator 28 as sensed by thermostat 146 which controls motor $M_3$ through control device $C_3$ for shifting slide valve $SV_3$ and its ejection port 94 in similar manner to that discussed with respect to slide valve $SV_2$.

It may be possible for both ejection ports 78 and 94 to be carried by the same ejection slide valve, for instance, slide valve $SV_2$, and it is conceivable that a single slide valve $SV_1$ may be employed, with one or more ejection ports carried on the inlet slide valve. Preferably, in the first case, the first stage regenerator temperature would be slaved to the second stage regenerator temperature, that is, thermostat 142 would be eliminated and thermostat 146 would control the position of the single slide valve bearing both ejection ports. If in fact both ejection ports or a single ejection port were carried by the inlet slide valve $SV_1$ to vary the expansion of the working fluid within the expander 14, depending upon system conditions, and in particular the available ability of thermal energy from its source dependent upon the temperature of media M (which is indirectly responsive to the amount of solar radiation S impinging upon that media M), the single slide valve $SV_1$ would have its position depend upon the pressure within the solar/reclaim boiler 32 as defined by pressure sensor 136 or other means sensing the availability of thermal energy to drive the expander and thus the generator 16. Further, since it is easier to eject gas at high volume from the female rotor than it is from the male rotor, it is preferably that the first stage regenerator 30 receive working fluid vapor through a port carried by a slide valve which is open to the female rotor FR while the second stage regenerator 28 receives its refrigerant vapor by way of a port carried by its slide valve $SV_3$ which opens to the male rotor MR.

Preferably, some of the high pressure liquid working fluid is remvoed from line 44 downstream of pump 50 as at point 160 and fed through line 162 to a fixed liquid injection port 164 on the expander casing 80 which opens to a closed thread of the expander expansion chamber at a point very close to the high pressure inlet 20 of that expander. This permits the injection of high pressure liquid to accomplish sealing by way of the organic working fluid or its equivalent near the high side of the rotor where the pressure is the highest and without materially adversely affecting the expansion process.

Turning back to FIG. 2, the ejection port 94 removes partially expanded working fluid at point C and directs that fluid which is at a pressure of approximately 100 psia and at a temperature of approximately 270° F. to the inlet 98 of the casing 52 for the second stage regenerator. Condensation of the working fluid vapor within regenerator casing 52 results in the working fluid in liquid form at R being pumped by pump 106 to the pressure of the main flow of fluid through line 44 from the condenser 26 to the solar/reclaim boiler 32. This is shown by way of points G and H on the diagram, FIG. 2, corresponding to conditions from outlet 100, FIG. 1, to line connection point 104 of line 44, just upstream of the first stage regenerator 30. It is noted that function of the second stage regenerator is to regenerate or add heat to the liquid working fluid R from condenser 26 which is at approximately 140° F. to raise it to a temperature of 250° F., that is from point J to point H while the first stage regenerator 30 adds additional heat from point A to point F to regenerate the temperature from 250° F. to 315° F. prior to entering boiler 32. The majority of the working fluid has expanded down to approximately 12.5 psia with a temperature reduction to 150° F. at point D, which is the condition of the working fluid R prior to entering inlet 42 of the condenser 26.

It may be appreciated, therefore, that by the utilization of the first and second stage regenerators and particularly by feeding partially expanded gas or vapor to those regenerators, it is possible by way of the two ejection ports 78 and 94 to approach fairly close to the thermodynamic theoretical Carnot cycle efficiency limits for the system. The two ejections in conjunction with their respective regenerators allow the working fluid or refrigerant to be raised from its condensing temperature level to a level close to the temperature level of the liquid circulating within the solar collection loop (or waste energy loop). If the regenerative effect is not utilized, it may be seen from the pressure enthalpy diagram that the solar input would have to be much greater as far as the energy content perpound of fluid back to the expander is concerned. The diagram shows that the approximate increase in enthalpy (BTU per pound) is on the order of a magnitude of approximately 63%, if regeneration is not utilized. Further, in the absence of bleeding off a portion of the working fluid during expansion within the single stage expander, in order to expand approximately 40 times as effected by the system of the present invention, it would be necessary to employ multiple expanders in a multi-stage arrangement. The utilization of controlled, automatically adjustable ejection ports as for instance ports 78 and 94 combined with the variable inlet and outlet ports 20 and 22 respectively, provides flexibility to the helical screw expander far beyond any possible flexibility that could be achieved with a radial inflow turbine operating under the same varying load conditions.

In conjuction with copending application Ser. No. 782,675, it may be appreciated that the expander may additionally be shaft connected to a compressor operating in a heat pump system under either cooling or heating requirements. Further, as the solar energy tends to be depleted in storage due to (when operating on a cooling cycle) either increasing load on the compressor and/or decreasing solar input, the expander inlet pressure must still be maintained quite high in order to guarantee reasonable cycle efficiency under off load conditions. As the inlet port is closed down, thus admitting less flow to the expander, that is, shifted from right to left, obviously the ejection point must move closer to the inlet as well in order that their respective pressure levels be properly maintained.

The ejection ports must move closer to the inlet port as well in order that their respective pressure levels be properly maintained. It is possible therefore that the inlet slide valve also carries one or more ejection ports since the direction of motion of the inlet slide valve to increase inlet port size would be in the same direction of motion to that direction of motion required for the ejection ports, in order that their pressure levels be properly maintained.

With respect to pumps 50, 92 and 106, these pumps preferably constitute gas powered piston pumps wherein the system gas pressure differential is employed to stroke a cylinder which would be used to pump a liquid to a higher pressure level. The pumps constitute, therefore, gas pressure powered piston cycled pumps of commercially available type.

In addition to the working fluid or refrigerant constituting trifluoroethanol, pure ethanol may be employed in addition to toluene, previously discussed. It is appreciated from the above that the combination of high pressure organic fluid as the working fluid or its equivalent, for the system, coupled with the positive displacement expander and the obvious thermodynamic advantages ensuing due to double regeneration, contribute to the unique ability of a single expansion stage helical screw rotary compressor of conventional expansion pressure ratio being capable of expanding the working fluid in a magnitude of 40 to 1 which, in the absence of the double regeneration bleed, the volume of the outlet vapor and CFM would be so large that multiple stages of expanders would have to be employed.

What is claimed is:

1. In an expander powered electrical generator system including a helical screw rotary expander having an expander casing, intermeshed male and female helical screw rotors mounted for rotation within said expander casing and forming with said casing a closed thread expansion chamber and having a high pressure inlet port and a low pressure outlet port at opposite ends of said helical screw rotors, and an electrical induction generator mechanically coupled to one of said rotors of said expander and being driven thereby, said system further comprising a condenser, a boiler, and conduit means carrying a vaporizable working fluid and forming a closed loop circuit including in series, the expander, the condenser and the boiler, said expander casing further including at least one movable slide valve and forming a part of the envelope for said expansion chamber, and motor means for shifting said at least one valve in response to a system operating parameter, and means for pumping the condensate from the condenser to the boiler, means for adding thermal energy to the working fluid within said closed loop at said boiler and for removing thermal energy from said closed loop working fluid at said condenser to effect vaporization of said working fluid within said boiler and condensation of said working fluid within said condenser, the improvement comprising:

at least one regenerator within the closed loop between the condenser and the boiler and having a regenerator heat exchange coil carrying the working fluid passing from the condenser to the boiler, said at least one slide valve including an ejection port open to a closed thread of the expander intermediate of the expander inlet and outlet and being connected to said at least one regenerator for supplying partially expanded working fluid in vapor form to said regenerator for regeneratively heating the condensed working fluid within said regenerator heat exchange coil passing from the condenser to the boiler, and means for adding the condensed working fluid within the regenerator to said closed loop downstream of said at least one regenerator and for raising the pressure of said condensed working fluid of said regenerator to that of said closed loop.

2. The expander powered electrical generator system as claimed in claim 1, wherein said at least one regenerator comprises a first stage regenerator and a second stage regenerator, said second stage regenerator is incorporated within the closed loop upstream of said first stage regenerator, said at least one slide valve comprises at lease two slide valves with said first slide valve carrying a first stage ejection port for supplying partially expanded working fluid in vapor form to said first stage regenerator and said second slide valve carries a second stage ejection port, and means are provided for connecting said second stage ejection port to said second stage regenerator for supplying to said second stage regenerator partially expanded working fluid in vapor form at a pressure less than that provided to said first stage regenerator, said system further comprising means for shifting said second slide valve in response to the temperature of the condensed working fluid within said second stage regenerator, and said system further comprises means for pressurizing and adding the condensed working fluid from said second stage regenerator to said closed loop upstream of said first stage regenerator.

3. The expander powered electrical generator system as claimed in claim 1, further comprising an injection port carried by said expander casing adjacent the inlet port of said expander but downstream thereof and opening to a closed thread cut off from said inlet port, and conduit means connected to said closed loop downstream of said pressurizing means and upstream of said at least one regenerator for supplying pressurized liquid working fluid to said injection port for injection into the expander expansion chamber and for sealing said intermeshed helical rotors.

4. The expander powered electrical generator system as claimed in claim 2, further comprising an injection port carried by said expander casing adjacent the inlet port of said expander but downstream thereof and opening to a closed thread cut off from said inlet port, and conduit means connected to said closed loop downstream of said pressurizing means and upstream of said second stage regenerator for supplying pressurized liquid working fluid to said injection port for injection into the expander expansion chamber and for sealing said intermeshed helical screws.

5. The expander powered electrical generator system as claimed in claim 1, wherein said at least one slide valve comprises first, second, third and fourth slide valves mounted to said casing and slidable longitudinally with respect thereto and defining a portion of the envelope for said expansion chamber, said at least one regenerator comprises a first stage regenerator and a second stage regenerator within the closed loop with said first stage regenerator downstream of said second stage regenerator, each of said regenerators comprises a closed casing carrying a heat exchange coil therein with said heat exchange coils being within said closed loop in series and in inverse order in the direction from the condenser to the boiler, said first slide valve comprises an inlet slide valve for controlling the system expansion ratio of the expander, said second slide valve comprises an ejection slide valve and carries a first stage ejection port for the first stage regenerator, said third slide valve comprises a second stage injection slide valve and carries a second stage injection port for said second stage regenerator, said fourth slide valve comprises a pressure matching slide valve and includes a pressure sensing port open to a compressor closed thread adjacent the outlet port of said compressor and sensing expander pressure immediately before discharge, said system includes means for connecting the first stage ejection port to said first stage regenerator casing and means for connecting the second stage ejection port to the second stage regenerator casing, said means for adding condensed working fluid at said at least one regenerator to said closed loop comprises lines leading from respective regenerator casings to the closed loop downstream of the respective casings, and said lines include additional pumps for pumping the condensed working fluid within respective regenerator casings to the closed loop pressure of the liquid working fluid being pumped from the condenser to the boiler, and said system further comprises means for varying the position of said second and third slide valves in response to liquid working fluid leaving temperature of said first and second stage regenerators, respectively, means for varying the position of said first slide valve in response to the pressure of the vapor generated within said boiler, and means for varying the position of said fourth valve in response to the difference between the pressure within the closed thread of the expander just before discharge and the outlet port pressure of said expander.

6. The expander powered electrical generator system as claimed in claim 1, wherein said expander and said generator are mounted within a hermetic casing with the generator downstream of said expander in the direction of expansion of the working fluid, and wherein the outlet port of the expander opens to the hermetic casing upstream of the generator to permit the generator to receive the discharge of the expander for cooling of the generator, and wherein said hermetic casing is connected to the inlet of the condenser such that the condenser receives expanded working fluid for condensation therein subsequent to cooling of the generator.

7. The expander powered electrical generator system as claimed in claim 5, wherein said expander and said generator are mounted within a hermetic casing with the generator downstream of said expander in the direction of expansion of the working fluid, and wherein the outlet port of the expander opens to the hermetic casing upstream of the generator to permit the generator to receive the discharge of the expander for cooling of the generator, and wherein said hermetic casing is connected to the inlet of the condenser such that the condenser receives expanded working fluid for condensation therein subsequent to cooling of the generator.

* * * * *